US006708471B1

(12) United States Patent
van Keken

(10) Patent No.: US 6,708,471 B1
(45) Date of Patent: Mar. 23, 2004

(54) RIDING SADDLE

(75) Inventor: Theodorus Jozef Maria van Keken, Scheltussingel 23, Amersfoort 3814 BG (NL)

(73) Assignee: Theodorus Jozef Maria van Keken, Amersfoort (NL)

( * ) Notice: Subject to any disclaimer, the term of this patent is extended or adjusted under 35 U.S.C. 154(b) by 0 days.

(21) Appl. No.: 09/647,088

(22) PCT Filed: Mar. 29, 1999

(86) PCT No.: PCT/NL99/00179

§ 371 (c)(1),
(2), (4) Date: Oct. 31, 2000

(87) PCT Pub. No.: WO99/50174

PCT Pub. Date: Oct. 7, 1999

(30) Foreign Application Priority Data

Mar. 27, 1998 (NL) ..... 1008736

(51) Int. Cl.[7] ..... B68C 1/02
(52) U.S. Cl. ..... 54/44.5; 54/44.1
(58) Field of Search ..... 54/37.1, 44.1, 54/44.3, 44.4, 45.1, 44.7

(56) References Cited

U.S. PATENT DOCUMENTS

| | | | | | |
|---|---|---|---|---|---|
| 42,583 | A | * | 5/1864 | Leurs | 54/44.1 |
| 1,213,329 | A | * | 1/1917 | Beal | 54/44.1 |
| 2,353,622 | A | * | 7/1944 | Boyle | 54/44.1 |
| 3,872,653 | A | * | 3/1975 | Thompson | 54/44.5 |

FOREIGN PATENT DOCUMENTS

| | | |
|---|---|---|
| DE | 723 068 C | 6/1942 |
| GB | 842 693 A | 7/1960 |

* cited by examiner

*Primary Examiner*—Robert P. Swiatek
(74) *Attorney, Agent, or Firm*—Merchant & Gould, P.C.

(57) ABSTRACT

A device for seating a rider on an animal, preferably a horse, the device comprising: a first frame member (20) having a proximal end, a distal end, and a middle section extending therebetween; a second side frame member (22) having a proximal end, a distal and a middle section extending therebetween, wherein the first and second frame members are attached in such a way as to create a sitting area for the rider between the first and second frame members.

15 Claims, 2 Drawing Sheets

RIDING SADDLE

BACKGROUND OF THE INVENTION

The present invention relates to a device for seating a rider on an animal, preferably a horse, and to the use of such a device for seating a rider.

The first riders rode bareback on horses without saddles, and held on to the horse by the mane.

The first leather saddles were developed by riders in the Asiatic steppes about 2000 years ago and enabled the riders to engage in combat, gallop after the enemy, fire arrows and the like all the time whilst remaining on the horse, which leads to the situation wherein the horse is uncontrollable and unpredictable, a dangerous state of affairs for both rider and horse.

During these last 2000 years the basic design of the saddle has remained the same, wherein saddle is built up around a central, solid, inflexible "tree" which extends centrally along the backbone of the horse. The rider sits on a seat arranged above this tree whilst the remaining parts of the saddle are built up therearound.

A disadvantage of these known saddles, is that they are relatively inflexible, which, when being placed on a moving horse whereby the backbone is constantly changing in form, leads to irritation, pain and sometimes injury for the horse.

SUMMARY OF THE INVENTION

An object of the present invention is to provide an improved saddle which substantially overcomes one or more of these problems.

According to a first aspect of the resent invention, here is provided a device for seating a rider on an animal, preferably a horse, said device comprising:

- a first side frame member having a proximal end, a distal end, and a middle section extending therebetween,
- a second side frame member having a proximal end, a distal end and a middle section extending therebetween, wherein the first and second frame members are attached in such a way as to create a sitting area for the rider between said first and said second frame members.

Since according to the present invention, the traditional central, solid tree is now replaced by a first and second side frame member which does not extend along the backbone of the horse, but which is arrangeable on either side of the backbone to provide a setting area therebetween, a seating device is provided which exerts substantially less pressure directly onto the horse's backbone in comparison with known saddles.

The rider now sits directly above the backbone of the horse without the solid tree being arranged between the rider and the backbone of the horse. This enables the rider to sit, as it were, directly on the back of the horse, whereby the rider is able to effect a better control of the horse.

Moreover, since the central, solid, inflexible tree is no longer necessitated with the device according to the present invention, injuries to the horse resulting from misformed trees, damage to the saddle itself due to a bent tree for example, and a painful seating position for the rider can be obviated.

The frame members are preferably equipped with support pads pivotally arranged thereunder to support the frame on the animal's back. In this way the device is able to react and move according to the movements of the horse's back to effect a secure, reactive seating whereby irritation points due to uneven pressure which can lead to injury to the horse are substantially obviated.

Further details and characteristics of the device according to the present invention are to be found in the claims.

According to a further aspect, the present invention relates to the use of the above device for seating a horse rider.

According to yet another aspect of the present invention, there is provided a method for assembling the device comprising the steps of:

a) pivotally arranging a frame comprising:
- a first side frame member having a proximal end, a distal end, and a middle section extending therebetween,
- a second side frame member having a proximal end, a distal and a middle section extending therebetween, wherein the first and second frame members are attached in such a way as to create a sitting area for the rider between said first and said second frame members,
- a distal joining frame member for joining the distal ends of the first and second side frame members together,
- a proximal joining frame member for joining the proximal ends for the first and second side frame members together on an undercover, and b) arranging a seat on this frame.

The invention will now be further elucidated by means of the following description and figures wherein:

DETAILED DESCRIPTION

Figure 1:
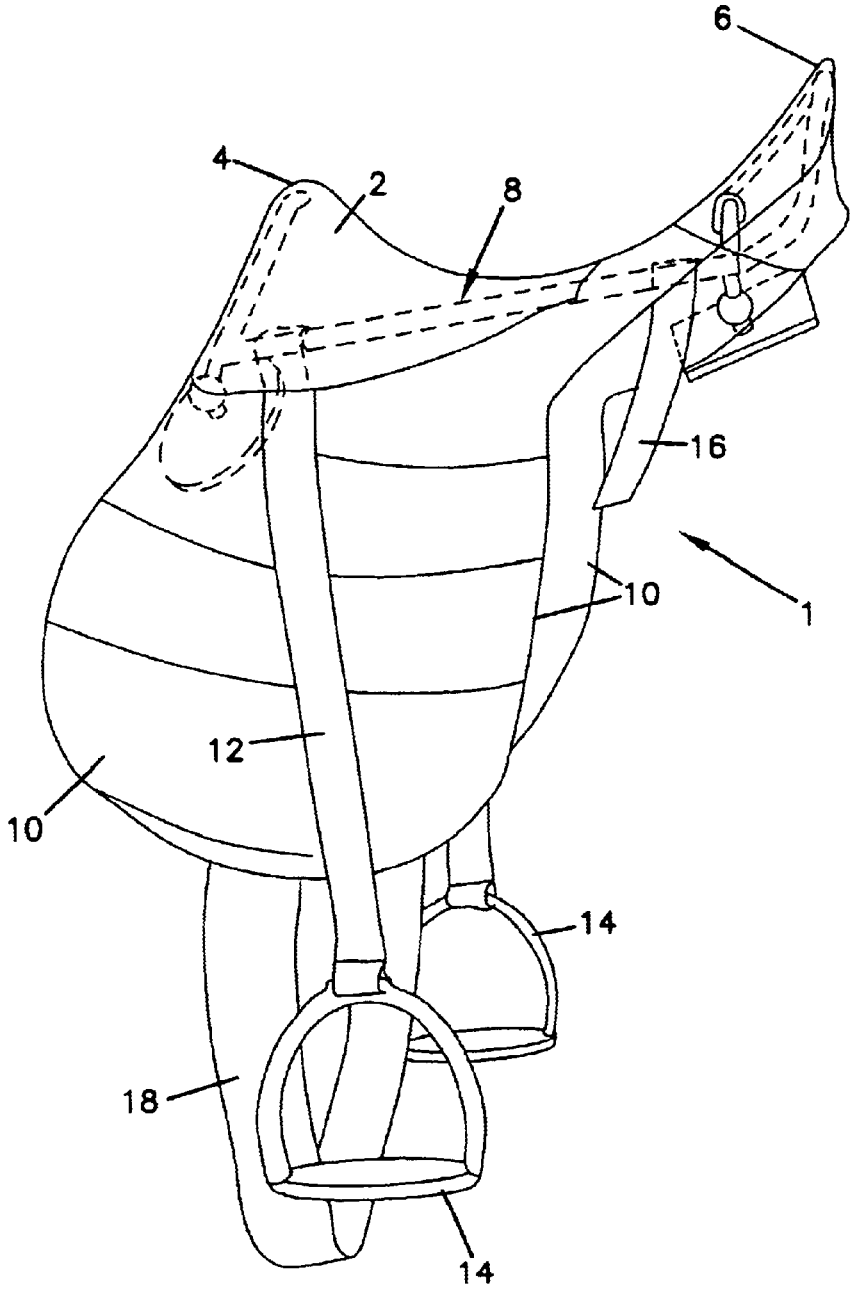
FIG. 1 is a perspective view of a saddle according to the present invention.

A saddle 1 comprises a seat 2 having a pommel 4 and a removable cantle 6 arranged on a frame 8, block flaps 10, stirrup supports 12 depending from the frame 8 along with stirrup irons 14 attached thereto, stirrup leathers 16 and a girth 18 (FIG. 1).

Figure 2:
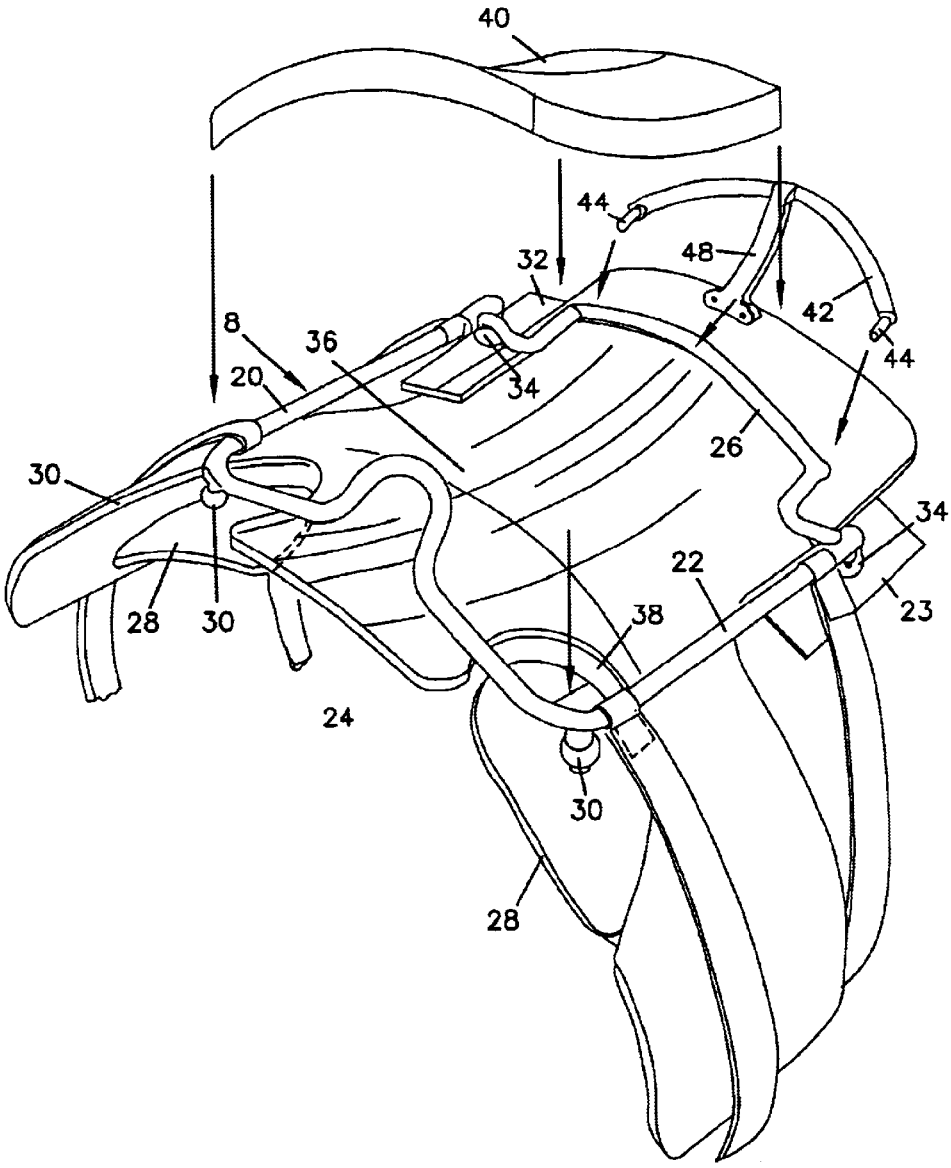
FIG. 2 is a perspective, partially cut away exploded view of the saddle according to the present invention.

The frame 8 comprises a first side frame member 20, a second side frame member 22, a front (proximal) joining frame member 24 and a rear (distal) joining frame member 26 (FIG. 2).

Two roughly heart-shaped support pads (28) pivotally depend from the junctures of the side frame members 20, 22 and the front frame member 24, which support parts 28 are pivotally attached to the frame by means of universal joints 30.

Two rectangular support pads 32 depend from the frame at the juncture between the side frame members 20, 22 and the rear frame member 26 and are also joined thereto by means of universal joints 34.

Since the support pads 28, 32 are attached to the frame by universal joints 30, 34, the support pads are able to remain flat against the horse's back, whilst the contour thereof changes during the movement of the horse, whereby these support pads 28, 32 fully cooperate with the changing movement of the horse's back. Since the frame is connected to the support pads 28, 32 by universal joints 30, 34, the support pads move substantially independently to the frame, whereby the frame, and thereby the seat remains substantially still on the horse. In this manner, irritation of the horse's back by means of a saddle exerting uneven pressures during movement of the horse's back is substantially obviated. The pads may also be equipped with silica gel layers/pressure distributors for comfort.

An undercover 36, which is continuous with the block flaps 10 is arranged under the frame and is provided with profiled cut outs 38 which extend around the front support pads 28.

A seating element 40 comprising a silica gel cushion is arranged between the side frame members 20, 22, the front frame member 24 and the rear frame member 26. A removable cantle element 42 is arranged on the rear frame member 26 by means of two terminal pin members 44 arrangeable in the rear frame member 26 and a central gripping stem 48 which grips around said rear member 26. Hence, the saddle according to the present invention can be equipped with different cantles, in order to provide a saddle for different uses.

Since both the cover 36 and the seating element 40 comprise silica gel layers, a massaging and pressure distribution effect is provided for the back muscles of the horse to provide good comfort. Furthermore, since the rider does not now actually sit on an inflexible tree, but rather between the frame members on the silica gel seating element, the frame members are much less susceptible to heavy wear and tear, which leads to an increased lifetime of the saddle.

The seat 2 including pommel 4 are arranged over the silica gel seating element 40 and frame as shown in FIG. 1.

The invention is not limited to the description, but is rather determined by the following claims.

What is claimed is:

1. Device for seating a rider on an animal, preferably a horse, said device comprising:

a first side frame member having a proximal end, a distal end, and a middle section extending therebetween, a second side frame member having a proximal end, a distal end and a middle section extending therebetween, a pommel supported by the proximal ends of the first and second frame members, and a cantle supported by the distal ends of the first and second frame members, and at least one joining frame member configured to secure the first and second frame members to each other and space apart the first and second frame members a predetermined distance, wherein the predetermined distance between the first and second side frame members defines a sitting area for the rider between said first and said second side frame members such that the weight of the rider is supported directly on the back of the horse between the first and second side frame members and is not supported by the first and second side frame members and the at least one joining frame member.

2. Device according to claim 1, wherein a flexible seating element is mounted in the seating area between the frame members.

3. Device according to claim 2, wherein the seating element comprises a silica gel cushion.

4. Device according to claim 2, further comprising a flexible layer mounted under the frame members and seating element for preventing direct contact of the frame members with the animal.

5. Device according to claim 2, further comprising a flexible cover mounted over the frame members and the seating element.

6. Device according to claim 1, wherein the at least one joining frame member connects the proximal ends of the first and the second side frame members.

7. Device according to claim 1, wherein the at least one joining frame member connects the distal ends of the first and second side frame members.

8. Device according to claim 1, wherein the at least one joining frame member includes a first joining frame member that connects the distal ends of the first and the second side frame members and a second joining frame member that connects the proximal ends of the first and the second side frame members.

9. Device according to claim 1, further comprising at least one support means pivotally mounted under each of the first and second frame members for supporting the first and second side frame members on the back of the animal.

10. Device according to claim 9 wherein the support means comprise pad-like members mounted at junctions between the side frame members and the at least one joining frame member.

11. Device according to claim 9, wherein each support means includes first and second pads secured to respective proximal and distal ends of each of the first and second side members.

12. Device according to claim 11, wherein the first and second pads are secured to the first and second side members with a universal joint.

13. Device according to claim 1, wherein a stirrup depends from each of the side frame members.

14. A device according to claim 1 configured for seating a rider on an animal.

15. Device according to claim 1, wherein the pommel restricts forward movement of the rider seated in the device and the cantle restricts rearward movement of the rider seated in the device.

* * * * *